US010640848B2

(12) United States Patent
Atwater et al.

(10) Patent No.: US 10,640,848 B2
(45) **Date of Patent: *May 5, 2020**

(54) METHOD OF CREATING POROUS STRUCTURES BY PARTICLE EXPANSION

(71) Applicant: Millersville University of Pennsylvania, Millersville, PA (US)

(72) Inventors: Mark Andrew Atwater, Quarryville, PA (US); Kris Allen Darling, Havre de Grace, MD (US); Mark Allen Tschopp, Jr., Bel Air, MD (US)

(73) Assignees: Millersville University of Pennsylvania, Millersville, PA (US); The United States of America As Represented By The Secretary Of The Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/241,345

(22) Filed: Jan. 7, 2019

(65) Prior Publication Data

US 2020/0024692 A1 Jan. 23, 2020

Related U.S. Application Data

(63) Continuation of application No. 14/811,049, filed on Jul. 28, 2015, now Pat. No. 10,280,485.
(Continued)

(51) Int. Cl.

| | |
|---|---|
| ***C22C 1/08*** | (2006.01) |
| ***B22F 3/11*** | (2006.01) |
| *B22F 9/04* | (2006.01) |

(52) U.S. Cl.
CPC ..... *C22C 1/08* (2013.01); *B22F 3/1143* (2013.01); *B22F 2009/043* (2013.01); *B22F 2998/10* (2013.01); *B22F 2999/00* (2013.01)

(58) Field of Classification Search
CPC ..... B22F 3/1143; C22C 1/08
See application file for complete search history.

(56) References Cited

U.S. PATENT DOCUMENTS 2,133,761 A 10/1938 Tietig
3,078,552 A 2/1963 Grandey
(Continued)

OTHER PUBLICATIONS

Vanleeuwen, B.K. et al., Novel technique for the synthesis of ultra-fine porosity metal foam via the inclusion of condensed argon through cryogenic mechanical alloying, Materials Science and Engineering A 528 (2011) 2192-2195.
(Continued)

*Primary Examiner* — Matthew E. Hoban
(74) *Attorney, Agent, or Firm* — Dinsmore & Shohl LLP

(57) ABSTRACT

A process for producing a metal foam. The process includes mechanically working a metallic powder such that oxide particles and/or dissolved oxygen are finely dispersed within a metallic matrix of the metallic particles that make up the metallic powder. The mechanically worked metallic powder is then annealed in a reducing atmosphere, where the reducing atmosphere is an atmosphere that results in the reduction of oxide and/or dissolved oxygen into vapor or gas molecules such that intraparticle porosity is formed within the metallic matrix by conversion of the oxide particles and/or dissolved oxygen to create vapor or gas molecules.

20 Claims, 6 Drawing Sheets

Related U.S. Application Data

(60) Provisional application No. 62/029,850, filed on Jul. 28, 2014.

(56) References Cited

U.S. PATENT DOCUMENTS

| | | | | |
|---|---|---|---|---|
| 4,659,546 | A | 4/1987 | Kearns | |
| 5,181,549 | A | 1/1993 | Shapovalov | |
| 10,280,485 | B2 * | 5/2019 | Atwater | B22F 3/1143 |

OTHER PUBLICATIONS

Rodriguez, J.A. et al., Reduction of CuO in H2: in situ time-resolved XRD studies, Catalysis Letters 85 (2003) 247-254.
Banhart, J. et al., Production methods for metallic foams, Materials Research Society 521 (1998) 121-132.

* cited by examiner

METHOD OF CREATING POROUS STRUCTURES BY PARTICLE EXPANSION

REFERENCE TO RELATED APPLICATION

This application is a continuation of U.S. patent application Ser. No. 14/811,049, filed Jul. 28, 2015, which claims priority to U.S. Provisional Patent Application Ser. No. 62/029,850, filed Jul. 28, 2014, the entire content of each application is incorporated herein by reference.

FIELD OF THE INVENTION

The present application relates generally to metal foams and in particular to metal foams formed from consolidation of metal particles having intraparticle porosity.

BACKGROUND OF THE INVENTION

Metallic foams and porous metal structures are valuable for their unique characteristics such as high specific strength, energy absorption at constant crushing load, efficient heat transfer and acoustic properties, all of which can be tailored by controlling the porosity. Many techniques for generating metal foams exist, but the vast majority of metal foam production is through liquid state processes such as the melt processing of aluminum by gas injection or decomposition of a dispersed foaming agent.

Aluminum has dominated the metal foam industry due to its low melting temperature and relative stability in air. However, reactive metals and those with higher melting temperatures require special processing, usually through solid state techniques. In addition, solid state foaming of metals by gas entrapment typically uses a two-step process: (i) entrapment of gas within interparticle voids during powder consolidation; and (ii) heating to expand the entrapped gas within the interparticle voids such that the internal pressure exceeds the yield strength and enables plasticity or creep to increase porosity. As such, the current limitation of solid-state expansion via gas entrapment is controlled by voids formed between solid particles during consolidation, i.e. initial gas pressure and annealing temperatures determine the resulting porosity.

In contrast, if the expanding gas is not limited to gas trapped between particles, but includes gas located within particles, solid state foaming could assume a character more akin to expandable polymers which foam from the constituent pellets. Therefore, an improved solid-state metal foaming process would be desirable.

SUMMARY OF THE INVENTION

A process for producing a metal foam. The process includes mechanically working a metallic powder such that oxide particles and/or dissolved oxygen are finely dispersed within a metallic matrix of the metallic particles that make up the metallic powder. The mechanically worked metallic powder is then annealed in a reducing atmosphere, where the reducing atmosphere is an atmosphere that results in the reduction of oxide and/or dissolved oxygen into vapor or gas molecules such that intraparticle porosity is formed within the metallic matrix by conversion of the oxide particles and/or dissolved oxygen to create vapor or gas molecules.

In some instances, the metallic powder is a silver containing metallic powder.

In some instances, the metallic powder is a copper containing metallic powder which may or may not also contain non-copper particles, e.g. antimony particles, to be mechanically worked. In addition, the mechanical working of the metallic powder can be ball milling. The ball milling can include room temperature ball milling and/or cryogenic ball milling.

It is appreciated that the reducing atmosphere is an atmosphere that results in the reduction of oxide particles and/or dissolved oxygen into vapor or gas molecules such that porosity is formed within the metallic matrix. It is not required for the reducing atmosphere to contain hydrogen. For example, the reducing atmosphere can be an inert gas mixture, an ammonia containing gas mixture, a CO-containing atmosphere and the like.

It is appreciated that the annealing in the reducing atmosphere can occur at a temperature less than or equal to 800° C., preferably less than or equal to 700° C., and still more preferably less than or equal to 600° C.

The process can also include compacting annealed ball-milled metallic powder into a desired shape, the desired shape after foaming having a porosity of at least 40/o, preferably at least 50% porosity, more preferably at least 60% porosity and still more preferably at least 65% porosity.

The process can also include sintering the annealed mechanically worked metallic particles into a desired shape. The desired shape has a metal foam structure and a porosity of the metal foam structure after foaming may be at least 40%, preferably at least 60%.

DETAILED DESCRIPTION OF THE INVENTION

Figure 1:
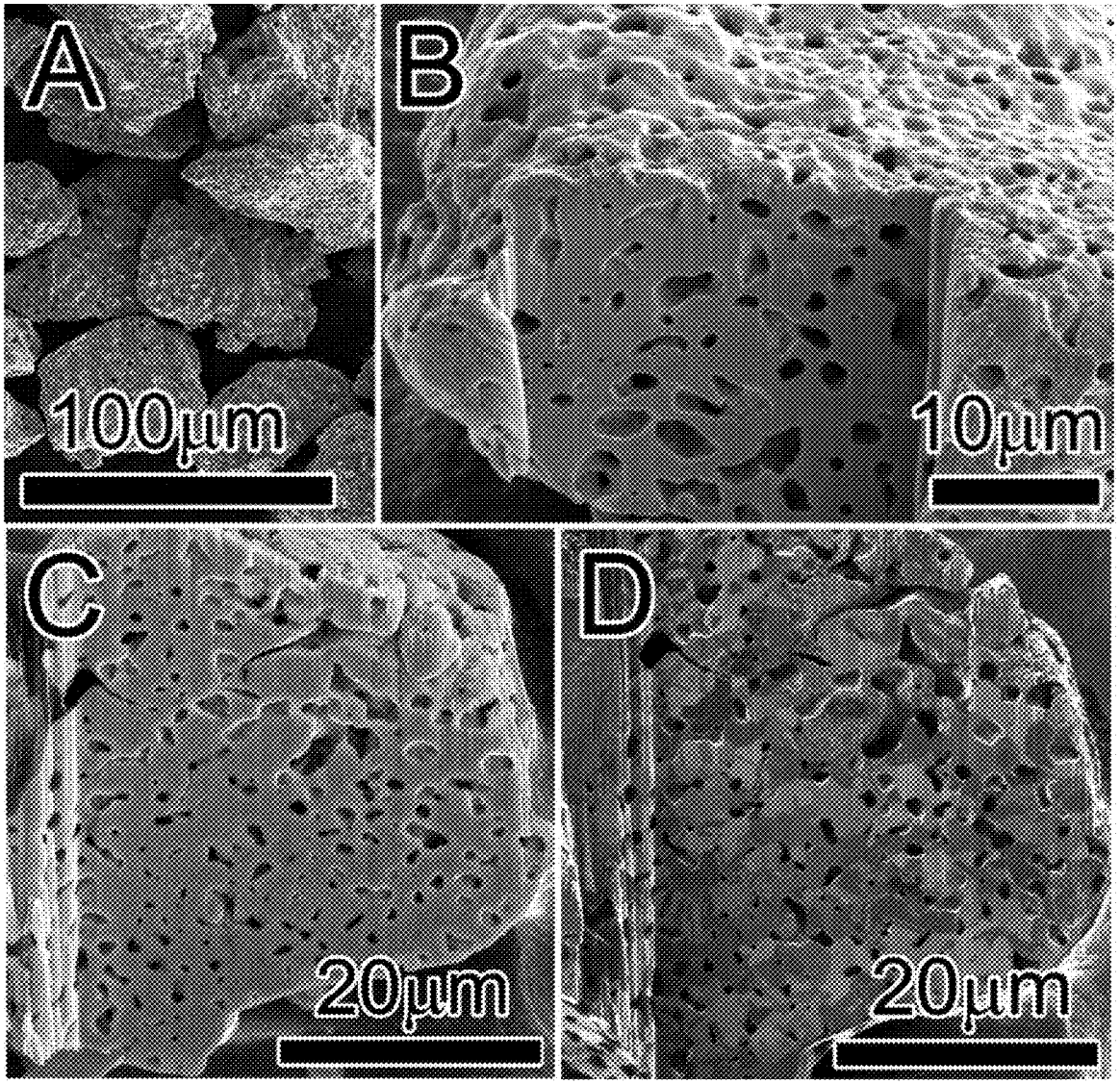
FIG. 1 is: (A) a scanning electron microscopy (SEM) image of loose powder; (B) an SEM image of a cross-sectioned particle; (C) an SEM image of a cross-section particle; and (D) a comparison focused ion beam ion channeling contrast (FIBICC) imaging of a cross-sectioned particle shown in (C)

An improved process for producing a porous powder is provided. In addition, the porous powder can be used to produce metal foam. Stated differently, the process provides a plurality of particles within intraparticle porosity that can be used to produce metal foam. It is appreciated that a powder is a plurality of particles and the terms "powder" and "particles" are used interchangeably herein.

The process includes mechanically working a metallic powder such that finely dispersed oxide particles are produced or are present within a metallic host matrix. For example, ball milling, extrusion and the like can be used to mechanically work the metallic powder.

After the metallic powder with finely dispersed oxide particles have been produced, the oxide containing powder is annealed in a reducing atmosphere. For example, a metal powder can be ball milled and annealed in a reducing gas atmosphere containing hydrogen, ammonia, etc. In the alternative, a combination of metal powders can be balled mill to produce a mechanically alloyed powder, which is then annealed in a reducing gas atmosphere. Examples of metal powders include powders made from titanium, chromium, manganese, iron, cobalt, nickel, copper, zinc, aluminum, niobium, molybdenum, silver and alloys thereof. In some instances, copper metal powder, with or without a copper alloying element powder, can be ball milled. In addition, the ball milling may or may not be conducted at cryogenic temperatures.

The ball milled powders contain oxygen. In some instances, the metal powder or combination of metal powders contain oxygen before being ball milled, however this is not required. Stated differently, the metal powder or combination of metal powders can have oxygen added thereto during the ball milling process. In addition, the oxygen can be present within and/or on the surface of the powder particles as adsorbed oxygen and/or as an oxide.

The reducing atmosphere can contain hydrogen, however this is not required. For example, the reducing atmosphere can be a pure hydrogen atmosphere, an inert gas-hydrogen mixture, an ammonia containing gas mixture, a CO-containing atmosphere and the like. For example, an argon-hydrogen ($Ar—H_2$) gas mixture can be used. In addition, the hydrogen reacts with the oxygen within and/or on the surface of the powder particles, e.g. oxygen in the form of oxide particles, during the annealing treatment to form steam ($H_2O(g)$). As such, it is appreciated that the reducing atmosphere is an atmosphere that results in the reduction of oxide particles and/or dissolved oxygen into vapor or gas molecules such that porosity is formed within the metallic matrix.

Annealing of the ball milled powder can occur at a temperature less than or equal to 800° C. In some instances, annealing occurs at a temperature less than or equal to 700° C. In other instances, annealing occurs at a temperature less than or equal to 600° C. In the alternative, annealing can occur at temperatures greater than 800° C. for faster kinetics.

It is appreciated that the inventive ball milled powder can be formed into a component having a desired shape before the annealing treatment. For example, ball milled powder can be pressed into the desired shape and then annealed, which in turn can serve as a sintering treatment. In addition, the annealed component can have a porosity of at least 10%, 20%, 30% or 40%, preferably at least 50%, more preferably at least 60%, and still more preferably at least 65%. It is also appreciated that "porosity" is a measure of the void (i.e., "empty") spaces in a material, and is a fraction of the volume of voids over the total volume, between 0 and 1, or as a percentage between 0 and 100%.

In an effort to better explain the invention and yet not limit its scope in any way, one or more examples are discussed below.

A copper-antimony (Cu—Sb) alloy powder was formed by mechanically alloying Cu and Sb powders (Alfa Aesar, 99.9% and 99.5%, respectively) at the cryogenic temperature of −196° C. for 4 hours (h) using a modified SPEX 8000M Mixer/Mill. The elemental powders were combined to achieve Sat % Sb in Cu. The as-milled powders contained no appreciable porosity and ball milling was used as a means to intimately mix the elements, and refine and distribute any preexisting oxides. Although oxygen exposure was controlled during milling and storage of powders, the manufacturer supplied precursors did contain appreciable oxygen content.

The alloyed powder was annealed at 600° C. for a period of 1 h under 3% $H_2$ (bal. Ar). In addition, the powders underwent pore formation and expansion during annealing. Furthermore, when annealing was conducted in the absence of $H_2$, no expansion was observed.

Microscopic examination of the loose powders was carried out using an FEI Nova Nano Lab 600 dual beam microscope using scanning electron microscopy (SEM) and cross-sectional analysis of powder particles was performed using a focused ion beam (FIB). The grain size and grain orientations were measured using focused ion beam ion channeling contrast (FIBICC) imaging and electron backscatter diffraction (EBSD), respectively. The FIB serial sectioning of the individual powder particles was used to visualize and quantify a representative three-dimensional (3D) pore structure in a volume 25.6 mm wide, 22.1 mm high, and 12.5 mm deep. The as-milled powders were also compacted in a die with a circular cross-section 3 mm in diameter for bulk measurements. Since as-milled powders were compacted, no initial porosity within the powders was lost and only porosity between particles was present before annealing. The compacts were weighed before and after annealing to measure the apparent density and changes in density were attributed to expansion within particles since little to no pore closure between particles was observed after compaction under the described conditions.

The annealed Cu—Sb particles were ≈60 μm in size and irregularly shaped after foaming as illustrated in FIG. 1A. Cross-sectional characterization of these particles revealed that significant expansion and/or void/porosity formation had occurred within each particle as shown in FIGS. 1B-1D. Also, a relatively even distribution of porosity was observed throughout each particle, with a mean equivalent pore diameter of 1.02 μm and a standard deviation of 0.89 μm as measured from 2D images (5588 pores). This is in contrast to the typical pore sizes reported as a result of gas expansion studies, which are on the order of 250 μm, i.e. over two orders of magnitude larger than pore sizes produced by the inventive process disclosed herein.

In addition to the above, and for the given temperature and hold time (600° C., 1 h), the pores were found to be highly interconnected, not only with each other, but with the free surface of their respective particles as well. Interestingly, the porosity did not create line-of-sight paths from surface-to-surface, even in small particles. Rather, the porosity formed tortuous passages from surface-to-surface, which was not entirely obvious without reconstructing the 3D pore structure.

The as-milled grain size and hardness of the Cu—Sb alloy powders were 9 nm and 3.5 GPa, respectively, as determined by X-ray diffraction analysis using Scherrer estimation and Vickers microindentation of individual particles. It is appreciated that a high-strength matrix is expected to suppress void expansion, but pure nanocrystalline (nc) materials are also notoriously sensitive to grain growth at elevated temperatures where they rapidly lose their strength (e.g., Cu begins grain growth at 75-100° C.). Herein, the Cu-5 at % Sb alloy powder had increased strength and thermal stability (a higher grain growth temperature) over pure nc-Cu. In addition to its influence on grain growth, Sb can influence the minimum foaming temperature. However, and despite some enhancement of strength and stability, Sb was found to be a poor stabilizing agent in nc-Cu at the expansion temperature of 600° C. and is potentially related to the large equilibrium solubility of Sb in Cu at elevated temperature (i.e. 5 at % Sb is fully soluble in Cu by ≈425° C.). In fact, the presence of Sb is actually thought to enhance solid state foaming since it dramatically lowers the solidus temperature to ≈660° C.

Figure 2:
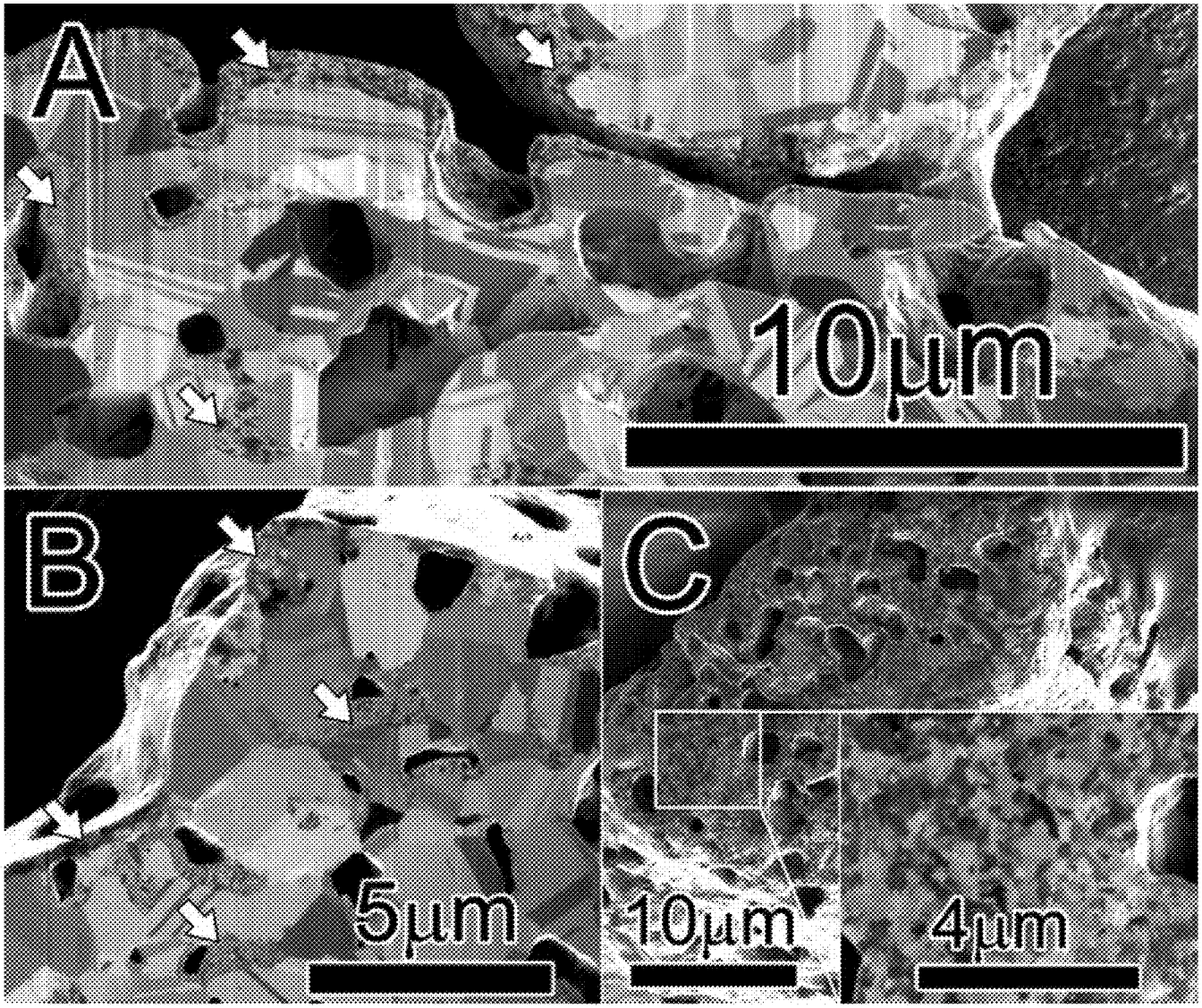
FIG. 2 is: (A) a low magnification FIBICC image of a cross-sectioned Cu-Sat % Sb alloy particle annealed at 600° C. for 1 h showing porosity and arrows indicating regions of small grains; (B) a high magnification FIBICC image of cross-sectioned Cu-5 at % Sb alloy particle annealed at 600° C. for 1 h showing pore structure and arrows indicating regions of small grains; and (C) a low magnification FIBICC image of cross-sectioned Cu-Sat % Sb alloy particle annealed at 600° C. for 1 h showing small grains within a higher magnification inset.
Figure 3:
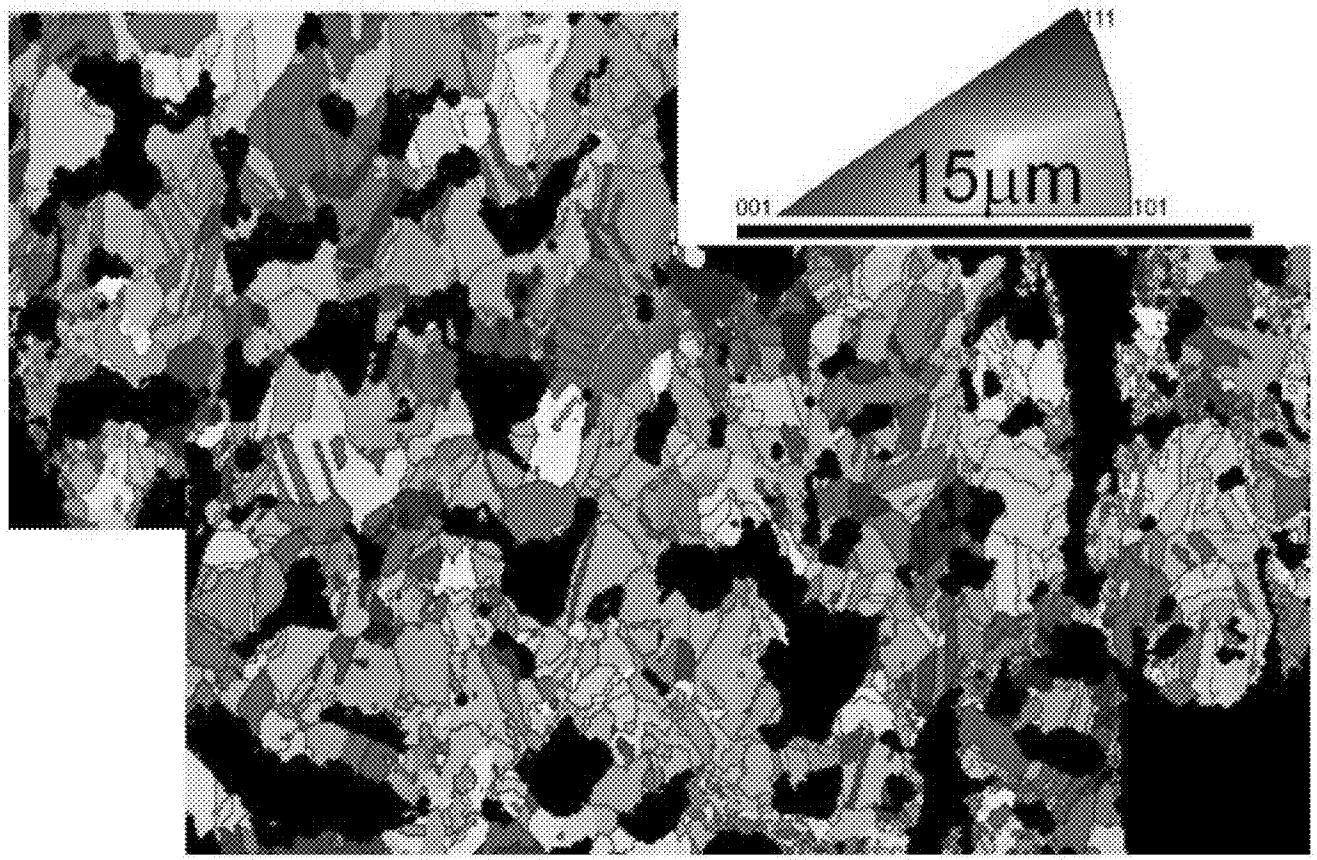
FIG. 3 is an electron backscatter diffraction (EBSD) image of a foamed particle cross-section illustrating the random grain orientation and fine grain size at free surfaces for a cross-sectioned Cu-Sat % Sb alloy particle annealed at 600° C. for 1 h.

Turning now to FIG. 2, a FIB cross-section of a foamed particle is shown. Also, FIBICC was used to determine the grain size within the structure and several features were apparent. First, the grain size was extremely small for a foamed material, with many of the grains being ≈1-5 μm in diameter. Second, there was an abundance of twins present throughout the bulk of the material. Third, there was a significant presence of nanoscale grains (indicated in FIGS. 2A and 2B by white arrows) primarily occurring at free surfaces within pores and at the particle exterior (see FIG. 2C). The EBSD confirmed the small grain size and showed a random texture (see FIG. 3). Additionally, dispersive X-ray spectroscopy (EDS) showed no variation in composition at these locations as compared to the bulk. It is appreciated that engineering of hierarchical features (nano grains, fine, micron grains, and pores) in fully foamed parts may lead to a greatly enhanced strength-to-weight ratio and thus unique applications.

Figure 4:
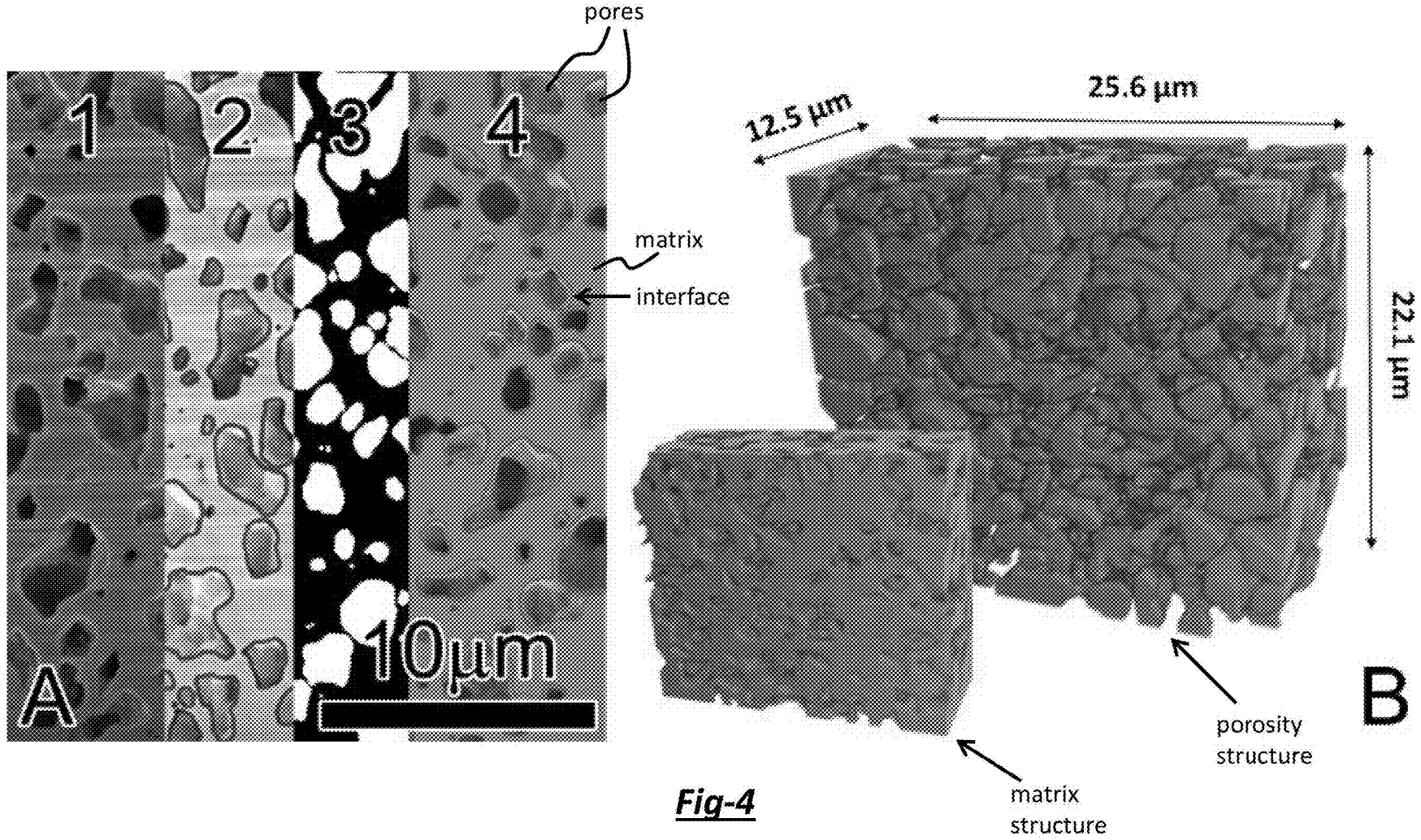
FIG. 4 is: (A) a 2D image showing different stages of analysis necessary to reconstruct a 3D volume including a: (1) captured image, (2) segmented image, (3) binary image, and (4) fused image; and (B) a 3D volume reconstruction of matrix structure (foreground) and pore structure (background) within a cross-sectioned Cu-Sat % Sb alloy particle annealed at 600° C. for 1 h.

The FIB serial sectioning and subsequent image analysis steps were performed to quantitatively describe the nature of porosity in the particles. For example, FIG. 4A shows one of the 2D images collected along with the different stages of analysis necessary to reconstruct the 3D volume shown in FIG. 4B. The four stages shown in FIG. 4A from left to right are: (1) initial image, (2) image with manual segmentation, (3) binary image highlighting pores (white) and matrix (black), and (4) fused image with matrix (green), pores (blue), and pore-matrix interface (red). Once pores were identified, adjacent slices were examined to further refine the image segmentation process. In total, fifty-one images having a 2048 pixel×1768 pixel area, 12.5 nm pixel$^{-1}$ resolution, and 250 nm spacing between images were used to fully reconstruct the 3D volume in a particle shown in FIG. 4B. The foreground image in FIG. 4B shows the matrix and the background image in FIG. 4B shows the pore structure along with dimensions of the 3D volume.

A number of porosity statistics were ascertained from the 3D volume. First, the volume fraction porosity of the 3D foam was 37.1% with a 3.6% standard deviation in pore area fraction from slice-to-slice. Second, two-point correlation functions indicated that a representative length scale for correlation in the 2D slices is on the order of 1-3 μm, as quantified by the convergence to the square of the area fraction, $A_f^2$, at larger distances. This length scale is in line with calculations of mean equivalent pore diameter (1.02 μm for 5588 pores). Third, pores in the 2D slices were non-spherical, as evaluated from the mean eccentricity value of 0.70 (i.e. 0 is perfectly circular, 1 is a line). It is appreciated that this finding is in agreement with studies showing that pore coalescence and interconnectivity results in a more tortuous pore structure. Further supporting this finding, the 3D connectivity of the pore structure revealed that 92.1% of the porosity was interconnected (i.e. "open" porosity). Last, the mean planar surface area per unit volume from the 2D images was calculated to be 0.94 μm$^2$ μm$^3$ or $9.4\times10^5$ m$^2$m$^{-3}$, which is related to the "true" surface area per volume of $1.2\times10^6$ mm$^{-3}$. In fact, this true surface per volume is equivalent to 0.235 m$^2$g$^{-1}$ which is comparable to the experimentally-measured value of 0.390 m$^2$g$^{-1}$ (i.e. using Brunauer-Emmett-Teller (BET) analysis). As such, the analyzed volume was representative of the true, bulk condition.

The Cu—Sb alloy powders were consolidated to assess the level of porosity achievable by simple sintering. The as-milled powders, prior to annealing, were compacted at 0.5, 1, and 2 GPa, and the apparent densities after annealing were 2.83 g cm$^3$ (31.3% dense), 4.06 g cm$^3$ (45.4% dense), and 4.75 g cm$^{-3}$ (53.1% dense), respectively. During annealing, samples expanded from their compacted density to a lower final density. The results are summarized in Table 1 below. The average expansion (change in apparent density) was =30% for each sample. This indicates that the compaction pressure directly affects the final density, but does not significantly impact the expansion process. The density of 31.3% (68.7% porosity) for the 0.5 GPa compact is a remarkable result for a powder metallurgy process, especially since the pore structure is not dominated by necks between sintered particles. The amount of porosity achieved, using such a basic process, clearly shows that the current limits of solid state foaming may be reached or even exceeded using the current methodology in association with other solid state foaming processes.

TABLE 1

| Compaction Pressure (GPa) | % Dense (compacted) | % Dense (annealed) | % Density Change |
|---|---|---|---|
| 2.0 | 83.5 | 53.1 | 30.4 |
| 1.0 | 69.4 | 45.4 | 24.0 |
| 0.5 | 62.2 | 31.3 | 30.9 |

For the high degree of foaming reported in the present study, an alternative (potentially more plausible) explanation for this phenomenon is proposed. The Cu powder used to create the alloy was produced by gas atomization, and the manufacturer's certificate of analysis reports an oxygen content of ≈5000 ppm. Hence, whether or not the expansion mechanism was related to the oxygen and/or oxide content of the powder was tested.

Not being bound by theory, it was hypothesized that annealing under a hydrogen containing atmosphere would reduce Cu oxide particles/precipitates and/or react with free oxygen within the Cu—Sb alloy particles to form water molecules. Then, voids would be created by the expansion of trapped steam.

This oxide reduction and/or oxygen reaction with hydrogen expansion mechanism was preliminarily tested by annealing compacted samples under rough vacuum (better than $10^{-2}$ Torr) and comparing the results to samples annealed in 3% $H_2$ (bal. Ar). In addition, the testing showed samples annealed under vacuum actually exhibited a slight increase in density rather than expansion, i.e. a decrease in density. Also, these same samples were annealed again in a reducing atmosphere and exhibited similar expansion as samples annealed only under $H_2$. This result confirmed the hypothesis that $H_2$ plays a key role in the expansion process.

The ability to achieve greater than 65% porosity, the ideal limit of gas entrapment, is an unexpected result, especially for a solid state foaming process. In addition, and since the expansion process is controlled by intraparticle interactions, there are considerable implications for reducing weight and/or improving the strength in bulk engineering structures produced via powder metallurgy.

Completely unique to the inventive process disclosed herein is the ability to create foamed powder. This powder can be used in loose form (primary) or in concert with traditional PM methods (additive). In particular, the inventive additional process can add up to 35-40% porosity by intraparticle expansion to current solid state foaming methods such as creep expansion, loose-powder sintering, fugitive templates, composite metals foams, and any other method which utilizes a powder feedstock. Moreover, combining porous particles with solid particles can afford for components with a graded density and unique properties.

Table 2 below provides a summary of pertinent characteristics for comparable techniques. The gas entrapment and loose-powder sintering data shown in the table were derived from D. C. Dunand, *Adv. Eng. Mater.* 2004, 6, 369. In addition, the Dunand data was for titanium and titanium alloys since these techniques are not commonly reported for Cu-base alloys. For this reason, the comparison was limited to aspects most transferable between the materials. In particular, intraparticle expansion was for loose powder only.

As shown in Table 2, the expanding feedstock in compacted samples creates a bimodal pore size distribution since the small, micron-sized pores are accompanied by larger, interparticle pores. As indicated, intraparticle expansion and sintering is essentially a combination of gas entrapment and powder sintering and displays the additive benefit of an expandable feedstock. The additive porosity maximum was determined by the typical porosity of the process and it was assumed the remaining solid portion would be expanded to 40% porosity. In the compacted samples processed in this work, this was consistently achieved.

TABLE 2

| Method Property | Intraparticle Expansion | Gas Entrapment | Loose-Powder Sintering | Intraparticle Expansion and Sintering |
|---|---|---|---|---|
| Typical porosity | ≈40% | ≈25-40% | ≈20-50% | ≈50-70% |
| Pore Size | ≈1-10 μm | 10's-100's μm | 10's-100's μm | Biomodal |
| Grain size | 1-5 μm | >50 μm | >50 μm | 1-5 μm |
| Process time | 1 h | 1-20+ h | 0.5-24 h | 1 h |
| Process T (% of melting) | 64.3% | 60.7-78.3% | 66%+ | 64.3% |
| Additive porosity maximum | N/A | 55-64% | 52-70% | 50-70% |

Figure 5:
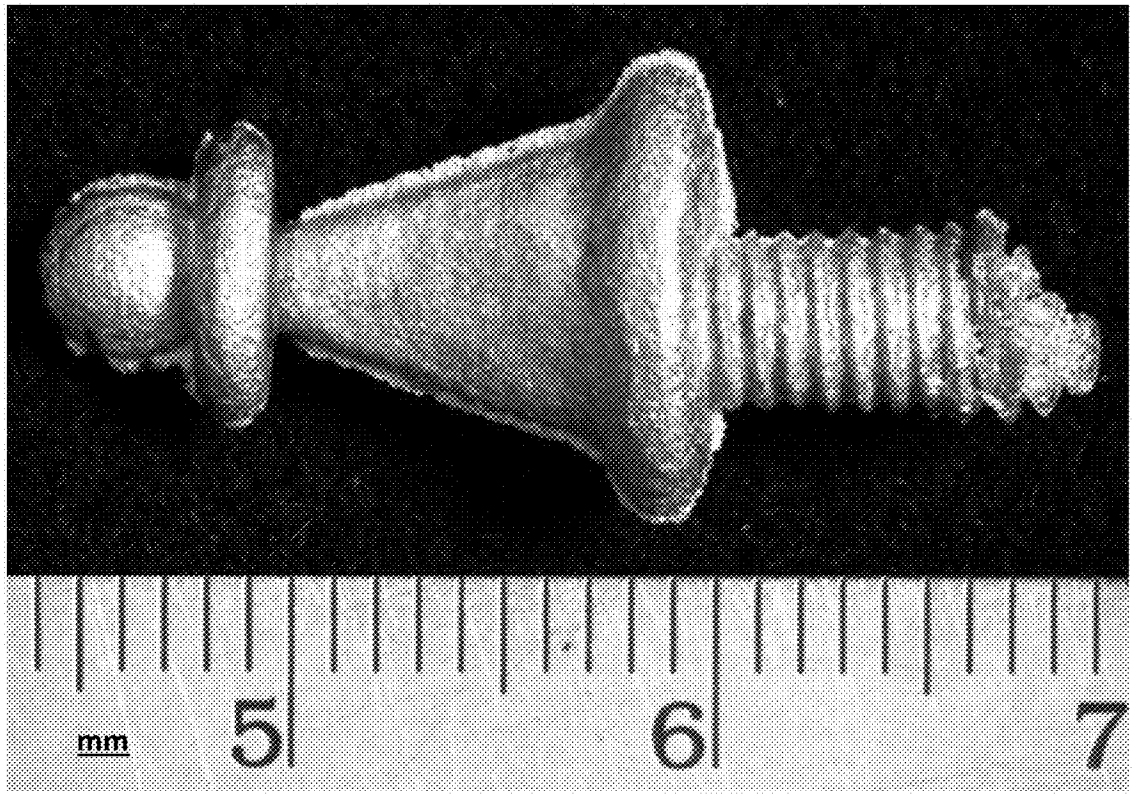
FIG. 5 is a photograph of "pawn" made by filling a two-piece mold with the Cu-5 at % Sb alloy powder, applying pressure at one end with a machine screw and annealing.

To determine whether simple annealing would be sufficient to generate a complex, sintered part, the Cu—Sb alloy powder was inserted into a pawn-shaped mold and annealed. The resulting part is shown in FIG. 5. The powder was compacted into the mold using only a screw (the threaded passage is apparent at the bottom of the pawn) and the detail of the threads and the accurate reproduction of the mold details indicate that this process can be utilized to produce intricate geometries. In light of these results, graded foam structures can be realized by simply blending foaming powders and non-foaming powders in specific ratios or patterns within a given mold structure. In this manner, the density and consolidated properties can be tailored for a particular application. There can be a number of potential applications if this process is extended to other metals and alloys, illustratively including custom dental or other biological implants, hydrogen fuel cells, plates or parts for advanced ballistic protection, etc.

Figure 6:
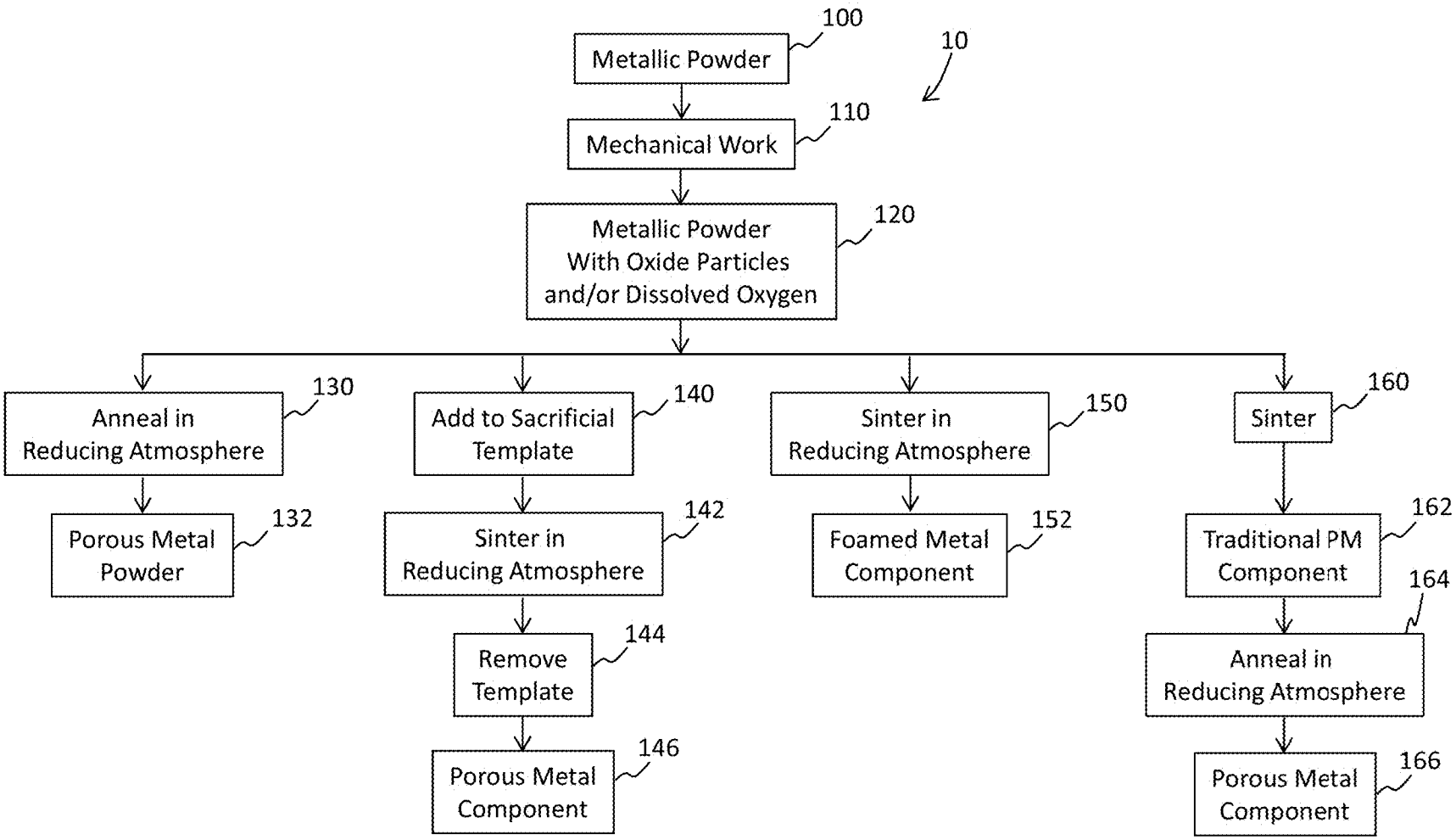
FIG. 6 is a schematic illustration of processes according to aspects disclosed herein.

Processes for producing metal foam, metal components from metal foam powder, etc., as disclosed herein are shown generally at reference numeral 10 in FIG. 6. The processes 10 include providing a metallic powder at step 100 and then mechanically working the metallic powder at step 110. As discussed above, the mechanical working can be executed via ball milling, extrusion and the like. The mechanical working of the metallic powder provides metallic powder, i.e. a plurality of metallic particles, provides oxide particles embedded in a host matrix of at least a portion of the particles and/or on the surface of at least a portion of the particles at step 120. It is appreciated that the host matrix can also contain absorbed or dissolved atomic oxygen and/or molecular oxygen.

In one process, the metallic powder with oxide particles and/or dissolved oxygen is annealed in a reducing atmosphere at step 130 and the metallic powder with intraparticle porosity is provided at step 132. In another process, the metallic powder with oxide particles and/or dissolved oxygen is added to a sacrificial template at step 140 and then sintered in a reducing atmosphere at step 142. It is appreciated that sintering in the reducing atmosphere can result in the oxide particles and/or dissolved oxygen undergoing a chemical reduction such that steam is produced and intraparticle porosity provided. The template is removed at step 144 and a porous metal component made from metal foam is provided at step 146.

In yet another process, the metallic powder with oxide particles and/or dissolved oxygen from step 120 is sintered in a reducing atmosphere at step 150 such that a foamed metal component having a desired shape is provided at step 152.

In still yet another process, the metallic powder with oxide particles and/or dissolved oxygen from step 120 is sintered using a traditional process at step 160 to provide a traditional powder metallurgy (PM) component at step 162 as is known to those skilled in the art. Then, the PM component is annealed in a reducing atmosphere at step 164 such that intraparticle porosity is formed as discussed above and a porous metal component is provided at step 166. It is appreciated that additional steps or processes can be included within the scope disclosed herein so long as a metallic powder with oxide particles and/or dissolved oxygen is annealed or sintered in a reducing atmosphere such that metal powder and/or a porous metal component with intraparticle porosity is provided.

In summary, a process for creating metal foams with porosities in excess of 65% via an intraparticle expansion solid state foaming process combined with powder sintering is provided. The relatively simple technique involves only two steps: milling the powder and then annealing the milled powder in a reducing atmosphere. The working hypothesis is that oxides and/or adsorbed oxygen within the particles are reduced/reacted during annealing to create creates steam, which in turn expands into voids. The porosity is very fine, averaging ≈1 μm in diameter, and is characterized by a non-spherical morphology. After 1 h at 600° C., the pores show extensive coalescence and percolation (>90% open porosity). The microstructure of a Cu—Sb alloy features a fine grain size replete with twins, and an ultra-fine to nanoscale grain size at many of the free surfaces.

The invention is not restricted to the illustrative examples described above. Examples are not intended as limitations on the scope of the invention. Methods, apparatus, compositions, and the like described herein are exemplary and not intended as limitations on the scope of the invention. Changes therein and other uses will occur to those skilled in the art. In addition, the contents of the attached Appendix A are included within the specification. As such, the specification should be interpreted broadly.

We claim:

1. A process for producing a metal foam comprising:

mechanically working a metallic powder such that oxide particles and/or dissolved oxygen are finely dispersed within a metallic matrix;

annealing the mechanically worked metallic powder in a reducing atmosphere, the reducing atmosphere being an atmosphere that results in the reduction of oxide and/or dissolved oxygen into vapor or gas molecules such that porosity is formed within the metallic matrix; and forming the metal foam of the annealed metallic powder having intraparticle porosity formed by conversion of the oxide particles and/or dissolved oxygen to create vapor or gas molecules.

2. The process of claim 1, wherein the metallic powder is a silver containing metallic powder.

3. The process of claim 1, wherein the mechanical working is ball milling the metallic powder.

4. The process of claim 3, wherein the metallic powder is a copper containing metallic powder.

5. The process of claim 4, wherein the ball milling alloys copper particles with non-copper particles.

6. The process of claim 5, wherein the non-copper particles are antimony particles.

7. The process of claim 3, wherein the ball milling, is cryogenic ball milling.

8. The process of claim 3, wherein the ball milling is room temperature ball milling.

9. The process of claim 1, wherein the reducing atmosphere is an inert atmosphere.

10. The process of claim 1, wherein the annealing occurs at a temperature less than or equal to 800° C.

11. The process of claim 9, wherein the annealing occurs at a temperature less than or equal to 700° C.

12. The process of claim 10, wherein the annealing occurs at a temperature less than or equal to 600° C.

13. The process of claim 1, further comprising compacting the annealed ball milled metallic powder into a desired shape.

14. The process of claim 13, wherein the desired shape has a porosity of at least 40%.

15. The process of claim 14, wherein the porosity is at least 50%.

16. The process of claim 15, wherein the porosity is at east 60%.

17. The process of claim 16, wherein the porosity is at least 65%.

18. The process of claim 1, further comprising the step of sintering the annealed mechanically worked metallic particles into a desired shape.

19. The process of claim 18, wherein the desired shape has a metal foam structure and a porosity of the metal foam structure after foaming is at least 40%.

20. The process of claim 19, wherein the porosity of the metal foam structure after foaming is at least 60%.

* * * * *